US009702527B2

(12) United States Patent
Wang et al.

(10) Patent No.: US 9,702,527 B2
(45) Date of Patent: Jul. 11, 2017

(54) LIGHT EMITTING DEVICE

(71) Applicant: Leotek Electronics Corporation, Taoyuan Hsien (TW)

(72) Inventors: Shih-Chang Wang, Taoyuan Hsien (TW); Po-Chang Li, Taoyuan Hsien (TW); Pin-Hao Hsu, Taoyuan Hsien (TW); Kun-Tsai Wu, Taoyuan Hsien (TW)

(73) Assignee: Lite-On Electronics (Guangzhou) Limited, Guangzhou (CN)

( * ) Notice: Subject to any disclaimer, the term of this patent is extended or adjusted under 35 U.S.C. 154(b) by 0 days.

(21) Appl. No.: 13/705,910

(22) Filed: Dec. 5, 2012

(65) Prior Publication Data

US 2013/0250584 A1 Sep. 26, 2013

Related U.S. Application Data

(60) Provisional application No. 61/614,019, filed on Mar. 22, 2012.

(51) Int. Cl.

| | |
|---|---|
| ***F21V 15/01*** | (2006.01) |
| ***F21V 23/04*** | (2006.01) |
| ***F21V 29/507*** | (2015.01) |
| *F21W 131/103* | (2006.01) |
| *F21Y 115/10* | (2016.01) |

(52) U.S. Cl.

CPC ..... *F21V 15/01* (2013.01); *F21V 23/0464* (2013.01); *F21V 29/507* (2015.01); *F21W 2131/103* (2013.01); *F21Y 2115/10* (2016.08)

(58) Field of Classification Search

CPC ... F21V 15/011; F21V 29/004; F21V 29/2225

USPC ..... 362/366

See application file for complete search history.

(56) References Cited

U.S. PATENT DOCUMENTS

| | | | | |
|---|---|---|---|---|
| 8,497,515 | B1 * | 7/2013 | Sagal | H01L 33/645 257/724 |
| 2006/0250803 | A1 * | 11/2006 | Chen | F21S 8/086 362/373 |
| 2007/0070628 | A1 * | 3/2007 | Chen | F21S 9/03 362/249.01 |
| 2007/0086196 | A1 * | 4/2007 | Wong | F21K 9/00 362/294 |
| 2009/0147521 | A1 * | 6/2009 | Zhang | F21V 7/0008 362/294 |
| 2009/0213588 | A1 * | 8/2009 | Manes | 362/235 |
| 2009/0296412 | A1 * | 12/2009 | Ogawa et al. | 362/373 |
| 2010/0073932 | A1 * | 3/2010 | Zheng | F21K 9/00 362/249.06 |

(Continued)

FOREIGN PATENT DOCUMENTS

| | | | | |
|---|---|---|---|---|
| WO | WO2011156886 | * 12/2011 | ..... | F21V 15/011 |

*Primary Examiner* — Anh Mai
*Assistant Examiner* — Zachary J Snyder
(74) *Attorney, Agent, or Firm* — The Farrell Law Firm, P.C.

(57) ABSTRACT

A light emitting device comprises a housing and a LED module. The housing comprises a first part and a second part connecting the first part, wherein the first part comprises a first side, a second side and a middle portion connecting the first side and the second side, and a thickness of the first side and a thickness of the second side are thinner than that of the middle portion. The LED module is disposed on the housing for emitting light.

26 Claims, 2 Drawing Sheets

(56) References Cited

U.S. PATENT DOCUMENTS

| | | | | |
|---|---|---|---|---|
| 2010/0097799 | A1* | 4/2010 | Shin | F21V 29/004 362/235 |
| 2010/0128475 | A1* | 5/2010 | Kovalchick et al. | 362/235 |
| 2011/0267837 | A1* | 11/2011 | Lee | G02F 1/133615 362/606 |

* cited by examiner

LIGHT EMITTING DEVICE

This application claims the benefit of U.S. provisional application Ser. No. 61/614,019, filed Mar. 22, 2012, the subject matter of which is incorporated herein by reference.

BACKGROUND OF THE INVENTION

Field of the Invention

The invention relates in general to light emitting device, and more particularly to a light emitting device with excellent heat dissipation efficacy.

Description of the Related Art

Currently, light emitting device, such as a light emitting diode (LED) lamp, has replaced the traditional fluorescent bulb lamp for some advantages such as higher lifespan, lower power consumption and smaller size. A LED lamp requires a light housing for fixing and protecting the LEDs. The heat dissipating efficacy of the light housing is important since the LEDs can be damaged by the thermal generating from the LEDs. Typically, a heat spreader is disposed on the heat dissipating side of the light housing for promoting the heat dissipating efficacy of the light housing.

In one type of the conventional LED lamp on street, heat spreader is exposed to the outside. This exposed heat spreader increases the surface area of the heat dissipating surface on the housing of the LED lamp, and remains the light emitting surface of the LED lamp at relatively low temperature when the high power LEDs on the light emitting surface of the LED lamp are working. However, the dust and sand are easily deposited on the gap of the exposed heat spreader.

However, heat dissipating efficacy of the light housing is unsatisfactory for the market requirements, since a large amount of the heat-insulating air surrounding the heat spreader are also enclosed in the light housing.

SUMMARY

Therefore, the present invention relates to a light emitting device with excellent heat dissipation efficacy.

The present invention provides a light emitting device comprising: a housing comprising a first part and a second part connecting the first part, wherein the first part comprises a first side, a second side and a middle portion connecting the first side and the second side, and a thickness of the first side and a thickness of the second side are thinner than that of the middle portion; and a LED module disposed on the housing for emitting light.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE INVENTION

Figure 1:
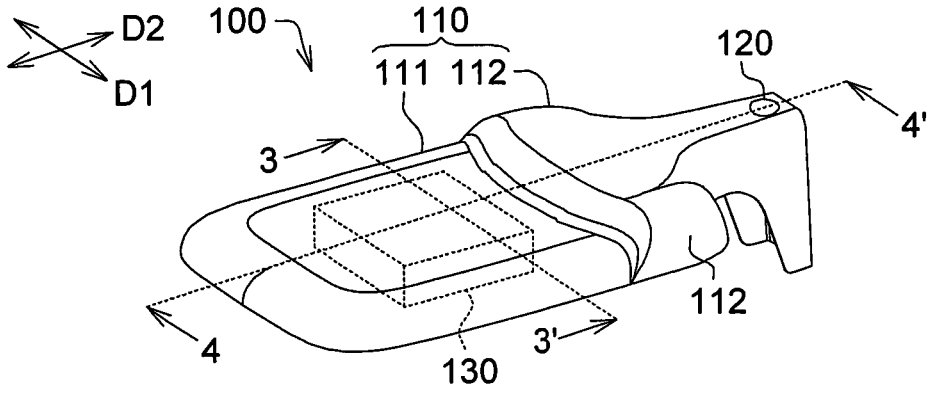
FIG. 1 illustrates a light emitting device according to one embodiment of the invention.

FIG. 1 illustrates a light emitting device according to one embodiment of the invention. The light emitting device 100 is a streetlamp, a stand lamp or illumination device, for example. The LED emitting device 100 comprises a housing 110 and a LED module 130.

The LED module 130 is disposed within the housing 110. The LED module 130 comprises a plurality of LEDs (not illustrated) and a substrate (not illustrated), wherein the LEDs are disposed on the substrate.

The housing 110 comprises a first part 111 and a second part 112 connected to the first part 111. The first part 111 and the second part 112 may be integrated into one piece by using way of die casting, for example. In addition, the housing 110 is made from thermal conductive metal material, such as aluminum, copper or a combination thereof.

The LED emitting device 100 further comprises a daylight sensor 120, which is disposed on the second part 112 of the housing 110 for detecting the daylight. A power saving mode (not illustrated) is switched on when daylight is detected by the daylight sensor 120, and the LEDs in the LED module 130 are driven to emit light.

Figure 2:
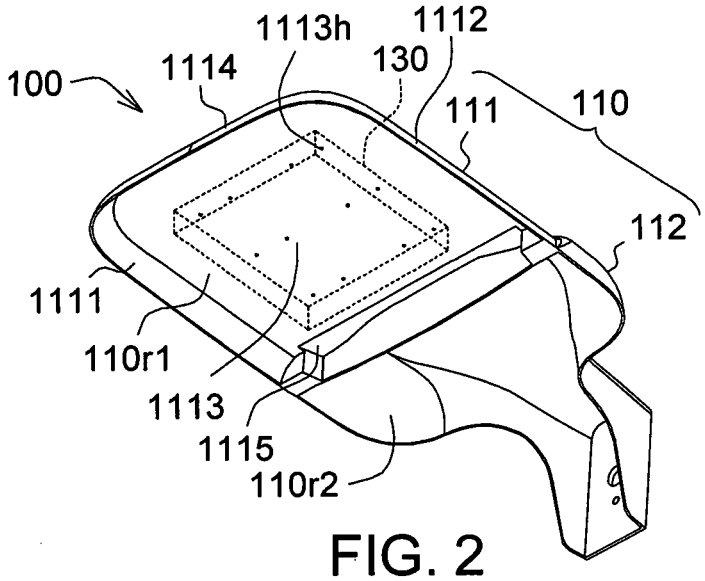
FIG. 2 illustrates a bottom view of the housing of FIG. 1.

FIG. 2 illustrates a bottom view of the housing of FIG. 1. The first part 111 has a first recess **110*r*1 and the second part 112 has a second recess 110*r*2, wherein the LED module 130 is disposed within the first recess 110*r*1, and at least one electronic element (not illustrated) is disposed within the second recess 110*r*2 to control the LED module 130. In addition, the region of the first recess 110*r*1 is defined by the first side 1111, the second side 1112, the third side 1114, the fourth side 1115 and the middle portion 1113**.

The LED emitting device 100 further comprises a bottom cover (not illustrated), wherein the bottom cover covers the first recess **110*r*1 and the second recess 110*r*2 to protect the LED module 130** from the invasion of dust and sand.

Figure 3:
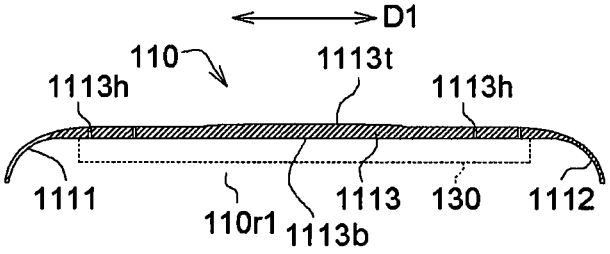
FIG. 3 illustrates a cross-sectional view of the first part of the housing in FIG. 1 along line 3-3'.

FIG. 3 illustrates a cross-sectional view of the first part of the housing in FIG. 1 along line 3-3'. The first part 111 comprises a first side 1111, a second side 1112 opposite to the first side 1111, and a middle portion 1113, wherein the middle portion 1113 connects the first side 1111 and the second side 1112, and the LED module 130 is disposed on the middle portion 1113. The first side 1111, the second side 1112 and the middle portion 1113 are extended along a first direction D1.

The middle portion 1113 has at least one hole **1113*h*. The LED module 130 is fixed in the first part 111 through at least one screw (if the hole 1113*h* is screw hole) or at least one fasten element fixing (not illustrated) in the hole 1113*h*. In addition, the hole 1113*h*** is blind hole or through hole, for example.

In FIG. 3, the housing 110 has a wall with non-uniform thickness. For example, the thickness of the first side 1111 and the thickness of the second side 1112 are thinner than that of the middle portion 1113, so that most of the heat generated from the LED module 130 can quickly be conducted to the first side 1111 and the second side 1112 from the middle portion 1113, and then most of the heat is convected away from the first side 1111 and the second side 1112. Under the circumstances, an extra heat spreader may not be required by the LED emitting device 100, but such embodiment is not meant to be limiting. In one embodiment, the thickness of the middle portion 1113 ranges between 1.0 and 8.0 times as much as that of the first side 1111 and/or the second side 1112.

In addition, the thickness of the first side 1111 is substantial equal to that of the second side 1112. In present embodiment, the first side 1111 and the second side 1112 are formed as a symmetrical structure. In another embodiment, the thickness of the first side 1111 is different from that of the second side 1112.

As shown in FIG. 3, the first side 1111 is extended downward below a bottom surface 1113*b* of the middle portion 1113 and getting thinner from an edge of the middle portion 1113. The second side 1112 is extended downward below the bottom surface 1113*b* of the middle portion 1113 and getting thinner from another edge of the middle portion 1113.

Figure 4:
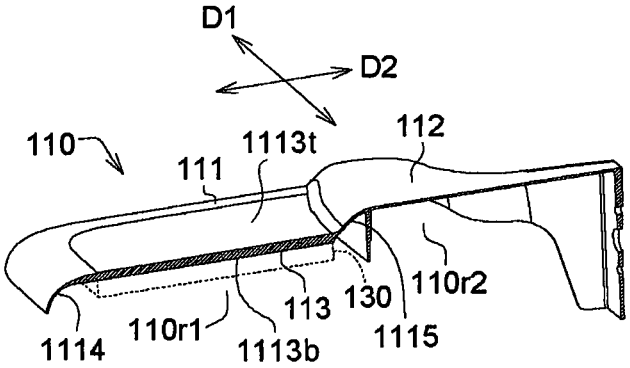
FIG. 4 illustrates a cross-sectional view of the housing in FIG. 1 along line 4-4'.

FIG. 4 illustrates a cross-sectional view of the housing in FIG. 1 along line 4-4'. The first part 111 further comprises a third side 1114 and a fourth side 1115 opposite to the third side 1114, wherein the middle portion 1113 connects the third side 1114 and the fourth side 1115. The third side 1114, the fourth side 1115 and the middle portion 1113 are extended along a second direction D2 substantially perpendicular to the first direction D1.

The thickness of the third side 1114 and the thickness of the fourth side 1115 are thinner than that of the middle portion 1113, so that most of the heat generated from the LED module 130 can quickly be conducted to the third side 1114 and the fourth side 1115 from the middle portion 1113, and then most of the heat is convected away from the third side 1114 and the fourth side 1115. Under the circumstances, an extra heat spreader may not be required by the LED emitting device 100, but such embodiment is not meant to be limiting. In one embodiment, the thickness of the middle portion 1113 ranges between 1.0 and 8.0 times as much as that of the third side 1114 and/or the fourth side 1115.

In addition, the thickness of the third side 1114 is substantial equal to that of the fourth side 1115. In another embodiment, the thickness of the third side 1114 is different from that of the fourth side 1115.

The third side 1114 and the fourth side 1115 are formed as an asymmetrical structure. For example, as shown in FIG. 4, the third side 1114 is extended downward below the bottom surface 1113*b* of the middle portion 1113 and getting thinner from an edge of the middle portion 1113, and the fourth side 1115 is extended upward above a top surface 1113*t* of the middle portion 1113 and getting thinner from another edge of the middle portion 1113. In another embodiment, the third side 1114 and the fourth side 1115 are formed as a symmetrical structure. For example, the third side 1114 is extended downward and getting thinner from an edge of the middle portion 1113, and the fourth side 1115 is extended downward and getting thinner from another edge of the middle portion 1113.

In FIG. 4, in another embodiment, the thickness of the fourth side 1115 may be substantial equal to that of the middle portion 1113, and the thickness of the second part 112 is thinner than that of the fourth side 1115 and that of the middle portion 1113, and so that most of the heat generated from the LED module 130 can quickly be conducted to the third side 1114 and the second part 112 from the middle portion 1113, and then most of the heat is convected away from the third side 1114 and the second part 112.

While the invention has been described by way of example and in terms of the preferred embodiment(s), it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A housing of a light emitting device, comprising:

a first part, wherein the first part comprises a first side, a second side and a middle portion connecting the first side and the second side, and a thickness of the first side and a thickness of the second side are thinner than a thickness of the middle portion and wherein the first part has a first recess and an LED module is disposed within the first recess and disposed on the middle portion; and a second part connecting the first part and having a second recess within which at least one electronic element is disposed to control the LED module, wherein the thickness of the first side gets thinner from an edge of the middle portion to a first free end of the first side, and the thickness of the second side gets thinner from an edge of the middle portion to a second free end of the second side, and wherein the first free end of the first side and the second free end of the second side are extended downward.

2. The housing according to claim 1, wherein the thickness of the first side is substantially equal to that of the second side.

3. The housing according to claim 1, wherein the first side and the second side are formed as a symmetrical structure.

4. The housing according to claim 1, wherein the first side is extended downward, and the second side is extended downward.

5. The housing according to claim 1, wherein the first side, the second side and the middle portion are extended along a first direction, and the first part comprises a third side and a fourth side opposite to the third side, wherein the middle portion connects the third side and the fourth side, and the third side, the fourth side and the middle portion are extended along a second direction substantially perpendicular to the first direction.

6. The housing according to claim 5, wherein a thickness of the third side and a thickness of the fourth side are thinner than a thickness of the middle portion.

7. The housing according to claim 5, wherein a thickness of the third side is substantially equal to that of the fourth side.

8. The housing according to claim 5, wherein the third side is extended downward and gets thinner from an edge of the middle portion, and the fourth side is extended upward and gets thinner from an edge of the middle portion.

9. The housing according to claim 5, wherein a thickness of the fourth side is substantially equal to that of the middle portion, and the thickness of the second part is thinner than that of the fourth side.

10. The housing according to claim 5, wherein the third side and the fourth side are formed as an asymmetrical structure.

11. A light emitting device, comprising:

a housing comprising a first part and a second part connecting the first part, wherein the first part comprising a first side, a second side and a middle portion connecting the first side and the second side, and a thickness of the first side and a thickness of the second side are thinner than a thickness of the middle portion and wherein the first part has a first recess; and an LED module disposed within the first recess and disposed on the middle portion of the first part of the housing for emitting light, wherein the second part has a second recess within which at least one electronic element is disposed to control the LED module, wherein the thickness of the first side gets thinner from an edge of the middle portion to a first free end of the first side, and the thickness of the second side gets thinner from an edge of the middle portion to a second free end of the second side, and wherein the first free end of the first side and the second free end of the second side are extended downward.

12. The light emitting device according to claim 11, wherein the thickness of the first side is substantially equal to that of the second side.

13. The light emitting device according to claim 11, wherein the first side and the second side are formed as a symmetrical structure.

14. The light emitting device according to claim 11, wherein the first side is extended downward, and the second side is extended downward.

15. The light emitting device according to claim 11, wherein the first side, the second side and the middle portion are extended along a first direction, and the first part comprises a third side and a fourth side opposite to the third side, wherein the middle portion connects the third side and the fourth side, and the third side, the fourth side and the middle portion are extended along a second direction substantially perpendicular to the first direction.

16. The light emitting device according to claim 15, wherein a thickness of the third side and a thickness of the fourth side are thinner than a thickness of the middle portion.

17. The light emitting device according to claim 15, wherein a thickness of the third side is substantially equal to that of the fourth side.

18. The light emitting device according to claim 15, wherein the third side is extended downward and gets thinner from an edge of the middle portion, and the fourth side is extended upward and gets thinner from an edge of the middle portion.

19. The light emitting device according to claim 15, wherein a thickness of the fourth side is substantially equal to that of the middle portion, and the thickness of the second part is thinner than that of the fourth side.

20. The light emitting device according to claim 15, wherein the third side and the fourth side are formed as an asymmetrical structure.

21. A housing of a light emitting device, comprising:

a first part, wherein the first part comprises a first side, a second side and a middle portion connecting the first side and the second side, and a thickness of the first side and a thickness of the second side are thinner than a thickness of the middle portion and wherein the first part has a first recess and an LED module is disposed within the first recess and disposed on the middle portion; and a second part connected to the first part and having a second recess within which at least one electronic element is disposed to control the LED module, wherein the first side, the second side and the middle portion extend along a first direction, and the first part further comprises a third side and a fourth side opposite to the third side, wherein the thickness of the first side gets thinner from an edge of the middle portion to a first free end of the first side, and the thickness of the second side gets thinner from an edge of the middle portion to a second free end of the second side, wherein the first free end of the first side and the second free end of the second side are extended downward wherein the middle portion connects the third side and the fourth side, and the third side, the fourth side and the middle portion extend along a second direction substantially perpendicular to the first direction, and wherein the third side extends downward below a bottom surface of the middle portion and becomes thinner from an edge of the middle portion, and the fourth side extends upward above a top surface of the middle portion and becomes thinner from an edge of the middle portion.

22. A light emitting device, comprising:

a housing comprising a first part and a second part connected to the first part, wherein the first part comprises a first side, a second side and a middle portion connecting the first side and the second side, and a thickness of the first side and a thickness of the second side are thinner than a thickness of the middle portion and wherein the first part has a first recess; and an LED module disposed within the first recess and disposed on the middle portion of the first part of the housing for emitting light, wherein the second part has a second recess within which at least one electronic element is disposed to control the LED module, wherein the first side, the second side and the middle portion extend along a first direction, and the first part further comprises a third side and a fourth side opposite to the third side, wherein the thickness of the first side gets thinner from an edge of the middle portion to a first free end of the first side, and the thickness of the second side gets thinner from an edge of the middle portion to a second free end of the second side, wherein the first free end of the first side and the second free end of the second side are extended downward, wherein the middle portion connects the third side and the fourth side, and the third side, the fourth side and the middle portion extend along a second direction substantially perpendicular to the first direction, and wherein the third side extends downward below a bottom surface of the middle portion and becomes thinner from an edge of the middle portion, and the fourth side extends upward above a top surface of the middle portion and becomes thinner from an edge of the middle portion.

23. The housing according to claim 1, wherein the housing is made from thermal conductive material and an extra heat spreader is not provided at a top surface of the first part or a top surface of the second part.

24. The housing according to claim 1, wherein the middle portion has a bottom plane, the first side has a first inner cambered surface which extends continuously downward, the second side has a second inner cambered surface which extends continuously downward, and the bottom plane connects the first inner cambered surface to the second inner cambered surface.

25. The light emitting device according to claim 11, wherein the housing is made from thermal conductive material and an extra heat spreader is not provided at a top surface of the first part or a top surface of the second part.

26. The light emitting device according to claim 11, wherein the middle portion has a bottom plane, the first side has a first inner cambered surface which extends continuously downward, the second side has a second inner cambered surface which extends continuously downward, and the bottom plane connects the first inner cambered surface and the second inner cambered surface.

* * * * *